United States Patent [19]

Szymanski et al.

[11] 4,456,367

[45] Jun. 26, 1984

[54] TONING SYSTEM FOR ELECTROSTATIC IMAGING APPARATUS

[75] Inventors: Michael J. Szymanski, Medford; Harold J. Weber, Sherborn, both of Mass.; Manfred R. Kuehnle, New London, N.H.; Kenneth D. Fraser, Scarborough, Canada

[73] Assignee: Coulter Systems Corporation, Bedford, Mass.

[21] Appl. No.: 348,761

[22] Filed: Feb. 16, 1982

[51] Int. Cl.[3] ..... G03G 15/10

[52] U.S. Cl. ..... 355/10; 355/4; 355/77; 118/645; 430/117

[58] Field of Search ..... 355/10, 4, 77; 118/645, 118/662; 430/117–119

[56] References Cited

U.S. PATENT DOCUMENTS

| | | | |
|---|---|---|---|
| 4,176,940 | 12/1979 | Katakabe et al. | 355/4 X |
| 4,247,191 | 1/1981 | Grace et al. | 118/645 X |
| 4,262,998 | 4/1981 | Kuehnle et al. | 430/117 X |
| 4,294,192 | 10/1981 | Nakai et al. | 430/119 X |

*Primary Examiner*—Richard L. Moses

*Attorney, Agent, or Firm*—Silverman, Cass & Singer, Ltd.

[57] ABSTRACT

A method and apparatus is provided for toning a latent electrostatic image on an exposed photoconductive surface of an electrophotographic member, using liquid toner comprising toner particles suspended in an electrically insulating liquid dispersant. Plural, generally identical, toner modules are arranged side by side at a first level, each module comprising a toner tray having a development electrode mounted on the upper surface thereof. The development electrode has a planar upper surface. A motor operates an articulated linkage which causes the tray to be elevated to a second level for toning, one of the modules being selected from the others. Antifriction bearing surfaces are mounted on the upper surface of the tray at opposite ends of the development electrode. The antifriction surfaces extend upwardly of the development electrode a short distance slightly above the upper surface thereof to define a gap between the development electrode and the surface to be toned. A toggle actuated control valve can be provided to direct the toner flow over the electrode in the direction of the movement of said surface, changing the direction of flow during the reciprocal movement of said surface. Alternatively, the flow of toner may be continuous over the planar electrode. During toning, a bias voltage is applied between the development electrode and the photoconductive surface to establish an electrical field within the gap for assisting toning. The charge level to which the toner responds is above the residual level thereby leaving the nonimaged or background area of the photoconductive surface free of toner particles.

38 Claims, 12 Drawing Figures

TO VALVE 22
TO VALVE 22

TONING SYSTEM FOR ELECTROSTATIC IMAGING APPARATUS

CROSS-REFERENCE TO RELATED APPLICATIONS

This application is an improvement over pending Kuehnle et al. Application Ser. No. 139,459 filed Apr. 11, 1980, ELECTROPHOTOGRAPHIC COLOR PROOFING APPARATUS.

BACKGROUND OF THE INVENTION

This invention relates generally to electrophoretically developing a latent electrostatic image contained on a photoconductive surface of an electrophotographic member with a liquid toner suspension, and more particularly concerns an improved electrophoretic toning system for an electrophotographic imaging apparatus.

Electrophotographic imaging apparatus normally includes a plurality of functional stations arranged in sequential proximity to an electrophotographic member, that is, to the photoconductive coating surface thereof. A surface charge potential is applied to the surface at a charging station.

The charged surface then is presented to an exposure or imaging station whereat light is projected thereto through a transparency forming a latent electrostatic charge image of the pattern carried by said transparency. The exposed surface then is brought to and past a toning or development station where toner suspension is applied to the electrostatic latent image carrying surface for rendering the same visible.

The image then is transferred to a transfer medium at the transfer station. After transfer, the photoconductive surface is cleaned of any residual toner and discharged to ground, said surface being returned to its initiate location for carrying out the same process but with a different transparency and, generally, a different toner.

The toner employed in the electrophoretic process can be viewed as a type of liquid ink comprising finely divided toner particles and a liquid dispersant. The conventional dispersant is an electrically insulating hydrocarbon, such as the isoparaffinic hydrocarbon liquid fraction sold in various grades by Exxon Company of Houston, Tex., under the trademark "ISOPAR". The toner particles dispersed in an insulating liquid may carry a positive or a negative polarity electrical charge. When the photoconductive surface is an n-type material such as cadmium sulfide, an electrical insulating liquid dispersant is employed wherein the toner particles carry a positive charge.

A description of one useful electrophotographic member which has high-speed and high resolution capability, is found in Kuehnle U.S. Pat. No. 4,025,339 of May 24, 1977. This member has a wholly inorganic, r.f. sputtered crystalline cadmium sulfide forming the photoconductive surface thereof.

Difficulties have been encountered in prior liquid toning systems in providing adequate density or darkness of the image color while maintaining the background of the image free of color. Image fogging is the condition referred to where, although the background of an image should be absolutely devoid of color some residual toner remains. Conventional electrostatic reproduction inherently has background fog because there is normally a surface noise field potential which attracts the toner particles. In order to obtain proper image density the toner must be uniformly deposited on the photoconductive surface of the electrophotographic member and the toner should be homogeneous. Additionally, the vapor point temperature of the toner should be such as to avoid producing excess evaporation.

The invention herein differs from prior liquid toning systems by providing means to enhance uniformity in the toner deposit while maintaining a homogeneous toner suspension. Accordingly, the toner suspension is agitated constantly and temperature rise of the toner is limited. It would be highly desirable to minimize fogging while providing a maximum density of the image to be toned. In the apparatus of the invention, of further advantage is the provision of toning means where precision machining is materially reduced, perhaps being required only for a planar development electrode.

The method and apparatus of the inventions is especially of value in imaging apparatus where multiple color toning is effected as for making color proofs. It thus is embodied in a module for single color apparatus and a plurality of toner modules for multiple color apparatus, each module having a different color associated therewith. Otherwise, the modules are identical and can be arranged side by side and adapted to be moved into functional position respectively on successive passes of an electrophotographic member relative thereto. The modules of an apparatus of this type can be removed individually for cleaning, servicing and replacement.

SUMMARY OF THE INVENTION

The invention provides a method and apparatus for toning a latent electrostatic image on a photoconductive surface formed on an electrophotographic member, comprising means for prewetting the photoconductive surface, a toning module including a planar toning development electrode mounted on the module and having an upper surface, a sump carrying a supply of suitable liquid toner, slot means extending along the length of the upper surface of the development electrode, spacing means for establishing a uniform gap between the development electrode and the photoconductive surface, means for establishing an electrical bias field across said gap, means for circulating the color toner within said sump and through said slot means to and uniformly through said gap, and means for reciprocably transporting the photoconductive surface and toning module relative one to the other.

Plural, interchangeable toning modules each carrying a different one of selected color toners are provided arranged removably, side by side. Each module conveniently can be removed from the framework for cleaning or other servicing.

Means for elevating a selected one of said modules are provided including a lift motor and antifriction bearing surfaces are mounted at the upper surface of the toning module at the opposite ends thereof, said surfaces extending slightly above the upper plane of the development electrode serve as spacing means to establish a toning gap between said development electrode and the photoconductive surface to be toned.

The photoconductive surface is wet with an electrically insulating liquid prior to applying the toner to minimize the level of background fog obtained on the developed image. The electrical bias field within the gap is preset for the selected color toners to provide proper density of toner on the image as well as aiding in minimizing background fog.

Toner can be flowed either continuously or can be flowed directionally across the planar development electrode in the direction of movement of the surface to be toned.

DESCRIPTION OF THE PREFERRED EMBODIMENT

According to the invention a method and apparatus are provided for developing a latent electrostatic image carried on the photoconductive surface of an electrophotographic member with a liquid toner for producing a print. The image is toned (or developed) at a high speed. A high resolution print of the image havng predeterminable color density and minimum background fog is produced by transferring the toned image on the photoconductive surface to a carrier medium such as a sheet of plain paper.

The invention herein was developed for the purpose of providing a trouble-free method of toning an electrophotographic member a plural number of times in as many passes with different toners at respective times so that a composite color image may be synthesized on a single paper member from a plurality of color separations representing a multi-color original picture or the like. In each pass a different separation is exposed on the charged electrophotographic member forming a latent electrostatic charge image which is toned and the toned image transferred, the electrophotographic member being cleaned between passes. The apparatus of the invention is ideally suited for this purpose and will be described as for this particular purpose. It should be appreciated, however, that the method and apparatus are applicable in imaging apparatus for achieving a transferred print from a monocolor original in which case there is only one pass of the electrophotographic member relative to the toning module.

The invention is therefore not limited to a multicolor print producing apparatus and method but has broader scope.

Figure 1:
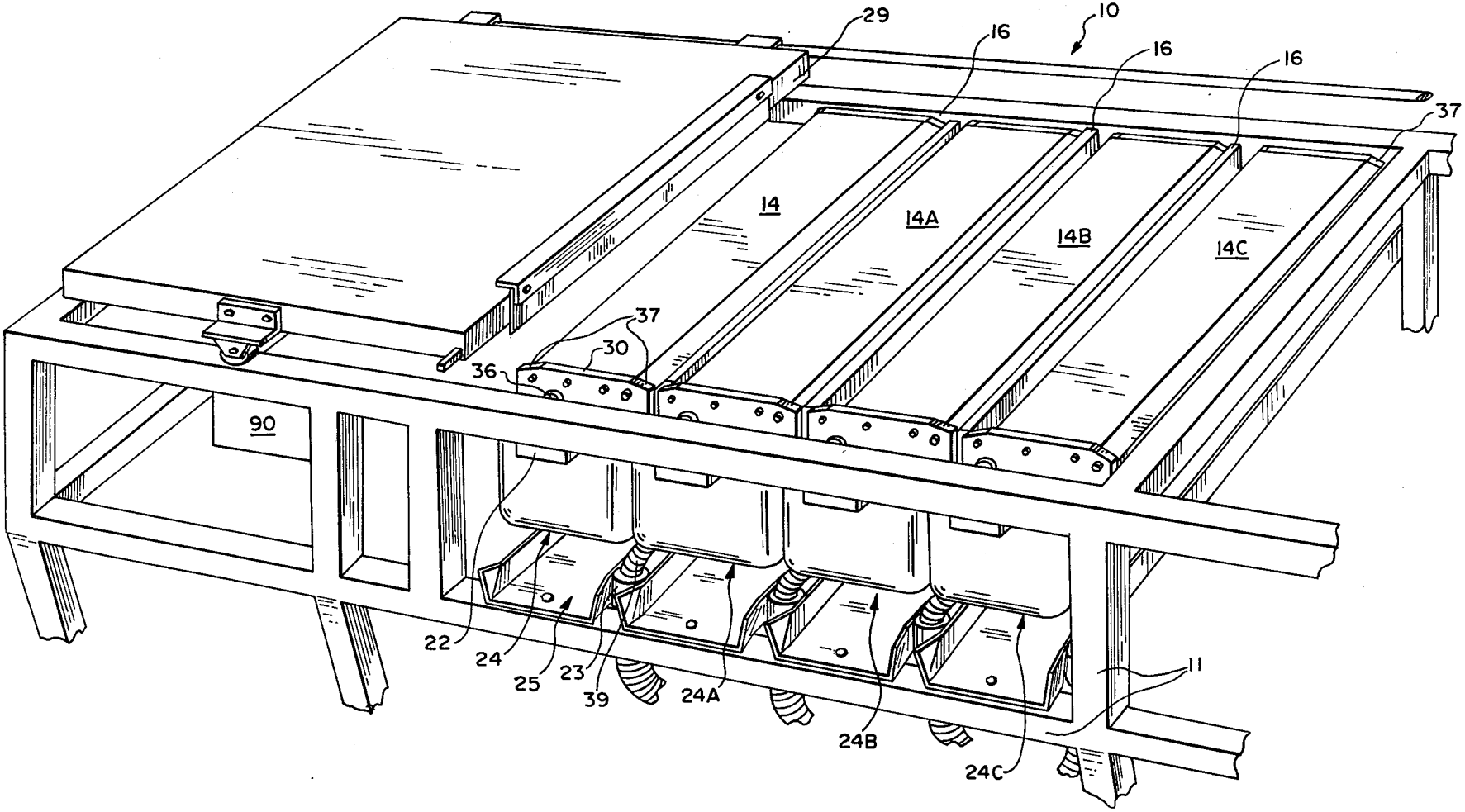
FIG. 1 is a fragmentary perspective view of a toning apparatus constructed in accordance with the invention, the housing normally enclosing the apparatus being removed.
Figure 2:
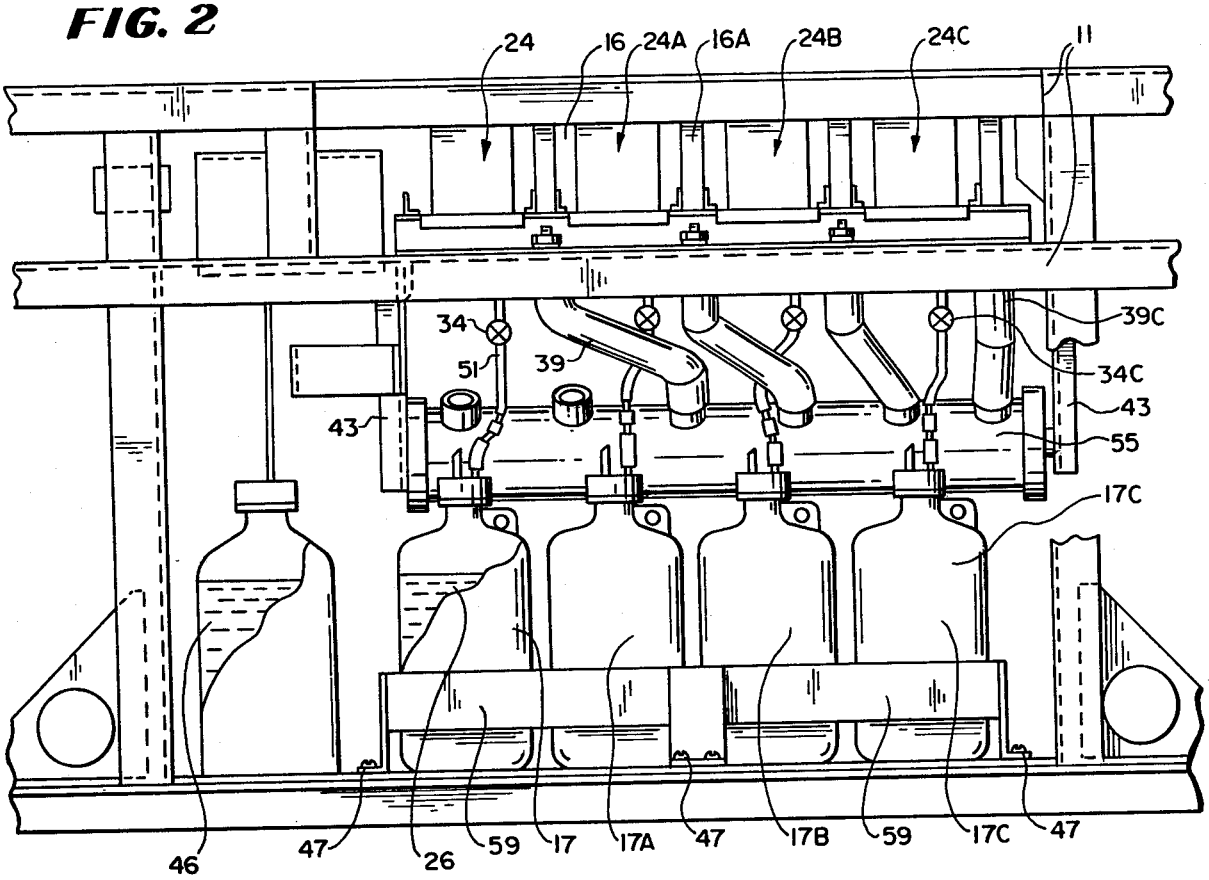
FIG. 2 is a fragmentary front elevational view of the toning apparatus shown in FIG. 1.

Referring to the FIGS. 1 and 2, the toning apparatus embodying the invention is designated generally by reference character 10.

Apparatus 10 comprises plural, side by side arranged self-contained toning modules which are interchangeable, each being capable of carrying a different one of the primary color liquid toners, namely, yellow, magenta, cyan, and black respectively. The four modules are substantially identical in constructions, each including a tray 12, a development electrode 14, a toner reservoir 17, a lift motor 18, a pump 20 and an articulated linkage coupled to the lift motor 18 for selectively elevating the tray from a first lower level to an upper second level, as will be explained hereinafter.

As shown in the Figures, each toner module includes a vacuum nozzle 16 adjacent one edge of the development electrode 14. Each module also is provided with a diverter flow control valve assembly 22 for directing the liquid toner across the development electrode in a preferred direction and for a preferred duration. Liquid toner can be directed over the development electrode 14 continuously in both the active toning state or when the particular module is inactive not toning. Where toner flow is continuous, there is no requirement to include the diverter flow control valve assembly 22. It will be understood that this apparatus 10 is intended to be part of a device for making, for example, color proofs from plural color separation transparencies.

The drawings illustrate a four module color toning system as a preferred embodiment although the essence of the invention is adaptable to one or any number of toning modules.

As shown, toner module 24 is capable of holding and applying yellow color toner, module 24A is capable of applying magenta colored toner, toning module 24B is capable of applying cyan colored toner while toning module 24C is capable of applying black toner. Each toning module is raised to the upper or toning level for application of the given color toner carried thereby. Each toning module is lowered to the first level when toning is completed. The modules 24, 24A, 24B, and 24C are each mounted on a shelf 25 secured across the framework 11. Each of the shelves 25 are spaced apart by cylindrical ring 23 to permit passage of the communicating conduits 51, 39 leading to the respective reservoirs 17 and vacuum manifold 15.

In view of the close identity of construction of these toning modules, only one (24) need be described to afford a full understanding of all.

Attention is invited to FIGS. 5–9 illustrating the toner tray 12. The toner tray 12 provides a reservoir or sump for a selected toner color 26, here yellow, the first to be applied color. The tray 12 is of a generally rectangular configuration having an open top 13.

Figure 5:
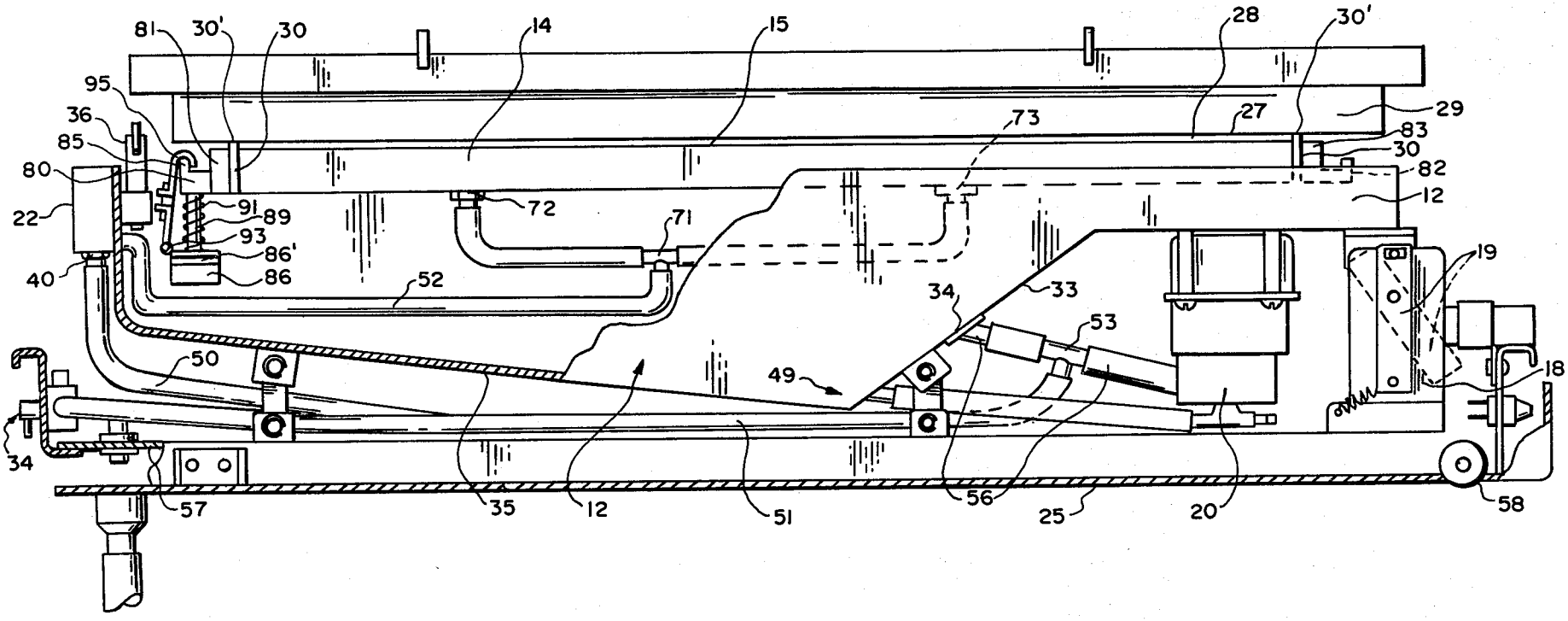
FIG. 5 is a fragmentary enlarged side elevational view on an enlarged scale illustrating one toning module of the toning apparatus of FIG. 1, portions being broken away to illustrate interior detail.

Referring particularly to FIG. 5, development electrode 14 is shown seated lengthwise across the top 13, the planar upper surface 15 thereof being disposed parallel to the photoconductive surface 27 of the electrophotographic member 28. The tray 12 includes a sump or reservoir chamber defined by inclined bottom walls 33 and 35, an inlet 34 thereto being formed in wall 33 near the well portion 49 of said sump chamber 12. Well 49 localizes the settling, if any, of suspended toner particles of the suspension. Conduit 56 is coupled between said inlet 34 and the low shear pump 20 via branced fitting 53. Conduit 51 is coupled between toner source reservoir 17 and said branced fitting 53. Conduit 50 is connected between pump 20 and inlet 40 of diverter valve assembly 22. The toner suspension is agitated during the circulation within the tray 12 by the pumping action.

Mounting of the development electrode 14, its construction and the means provided by the invention for cooperating with the platen 29 to precisely define and maintain the uniform toning gap required are best explained with reference to FIGS. 6 to 9 of the drawing and reference is made particularly thereto.

A pair of identical runners 30, each having an upwardly facing antifriction bearing surface 30', are mounted adjacent the shorter ends of tray 12 and adjacent the opposite ends of the development electrode 14.

Mounting bar members 81 and 83 are secured fixedly to the opposite shorter ends respectively of tray 12. Retaining bars 80 and 82 are secured to said mounting bars 81, 83 respectively, each retaining bar 80,82 being provided with unitary flanges 85,87 along the upper surfaces thereof. Bridges 86 are mounted respectively across the interior of the tray 12 at opposite ends and below the top 13.

Upstanding pins 89 are seated securely on each bridge 86, and coil springs 91 of limited resilience are seated thereon. Spring clamps 91 are mounted on the bridges 86, the arm 86' thereof pivoting at 93 to enable the hook portions 95 thereof to be forced against its normal bias and return to engage over the flange 85,87. The development electrode 14 thusly is spring mounted for limited movement upwardly and downwardly in a plane oriented horizontally.

The upper slide surfaces of antifriction bearing runners 30 are coplanar occupying a horizontal plane parallel to the planar upper surface 15 of the development electrode 14.

The ends 37 of the bearing surface 30 are beveled and function as cam surfaces. Mounted on springs 91, the electrode 14 is capable of limited bidirectional movement vertically while disposed in a horizontal plane parallel to the surface to be toned.

The liquid toner 26 comprises tone particles, here yellow in color, suspended in an electrically insulating liquid hydrocarbon dispersant such as marketed by Exxon Co. under the trademark ISOPAR. The particles tend to settling out of their suspended state to collect on the bottom of the tray 12 when stagnant.

Slots 31 and 32 are defined adjacent the longer edges thereof and extending substantially the length of the electrode 14. The toner 26 in the tray 12 of the invention is constantly agitated and recirculated by the toner circulating pump 20. Pump 20 is connected to the primary inlet 40 of valve 22 through conduit 50 shown in FIG. 5. Conduit 56 connects the pump 20 with tray 12. Properly homogeneous toner 26 is maintained by this action, combined with a minimum of surfaces and trapped areas where toner flow rate is low. Pump 20 is located outside toner tray 12 so as to avoid increasing the temperature of toner 26 thereby inhibiting toner evaporation.

As viewed in FIG. 5 the module 24 is shown to have a bottom surface 57 and a roller or wheel member 58 provided for inserting and removing the module 24 conveniently from shelf 25 shown in FIG. 1.

Each of the toner colors is stored in a respective one of the bottles of reservoirs 17, 17A, 17B, and 17C and coupled to the respective pumps 20 and to the interior chamber of each tray 12 respectively. A manually operated valve, such as stepcock 34 (FIGS. 2 and 5) can be provided to control flow of liquid toner from the reservoirs 17.

A vacuum nozzle 16 can be provided adjacent each toner tray 12 as a component of the toning module 24.

Figure 3:
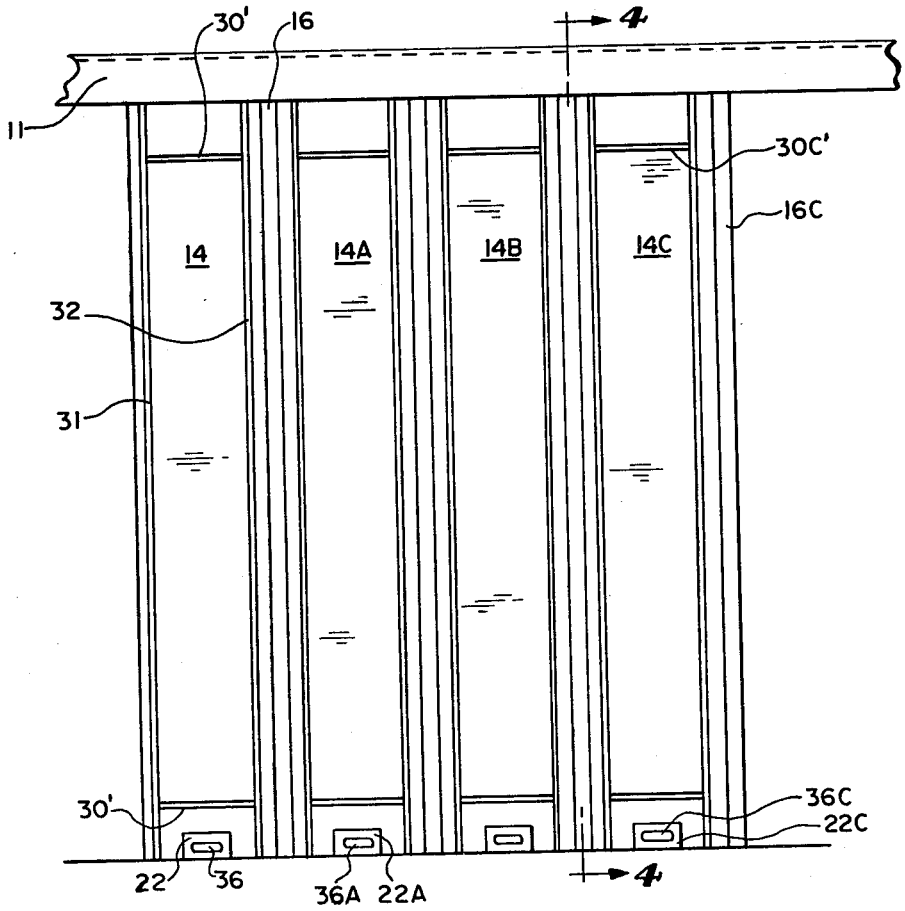
FIG. 3 is a fragmentary top plan view of the toning apparatus of FIG. 1.

A common vacuum motor (not shown) coupled to a vaccum manifold 55 provides a source of vacuum directed to each vacuum nozzle 16 that extends along the length of the toner tray 12 and adjacent thereto as shown in FIGS. 1, 2, and 3.

Figure 10:
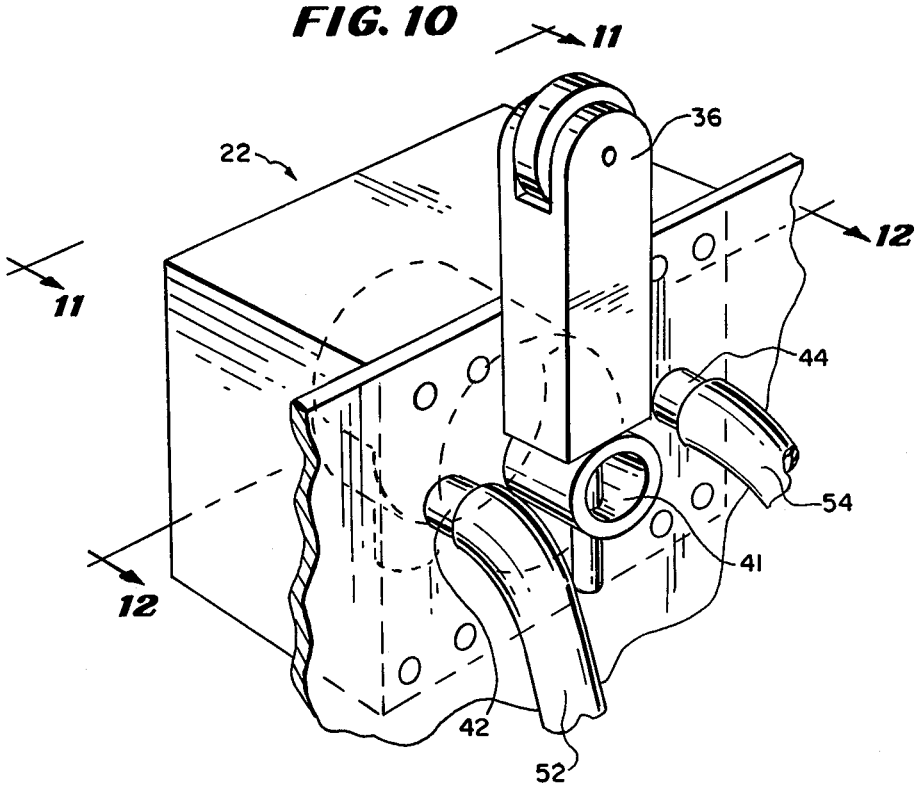
FIG. 10 is a perspective view of a directional valve carried by the toning module.
Figure 11:
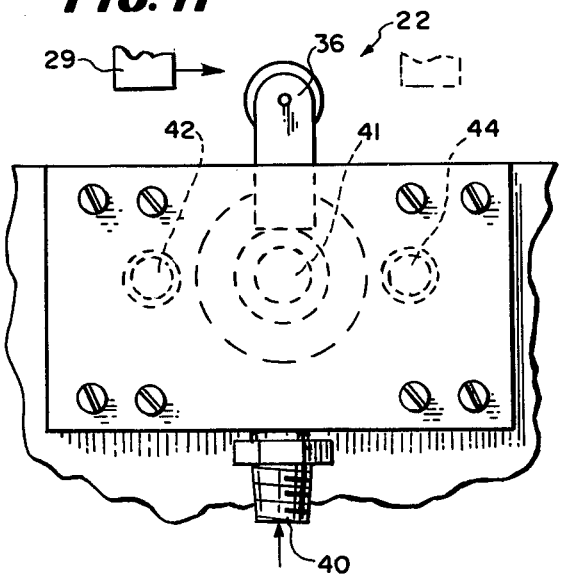
FIG. 11 is an elevational view of the valve of FIG. 10 taken generally along the line 11—11 and viewed in the indicated direction.
Figure 12:
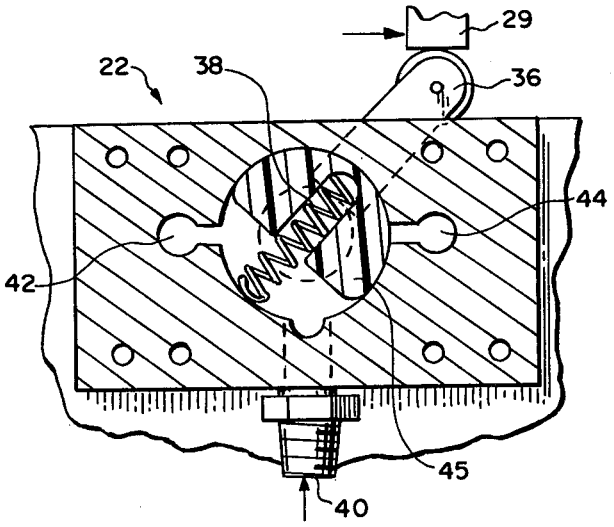
FIG. 12 is a sectional view of the valve of FIG. 10 taken generally along the line 12—12 and viewed in the indicated direction.

Alternatively, the toner module 24 can be modified to cause flow of liquid toner continuously over the planar surface 15 of said development electrode 14, either on a continuous basis regardless of the horizontal level at which said electrode is disposed. The liquid toner 26 may be circulated continuously over the said planar surface (toning module). In these embodiments, the diverter valve 22 can be omitted.

Where provided, as is illustrated in apparatus 10, the toning valve 22 comprises a valve body, inlet fitting 40, primary outlet 41, secondary outlets 42 and 44, diverter 45, a toggle-like actuator 36 and an extension spring 38. The valve actuator 36 may be mechanically or electrically activated. FIGS. 10, 11, and 12 illustrate the preferred embodiment for a mechanically actuated valve. The platen 29 which carries the surface to be toned facing the toning station is moved into contact engagement with actuator 36 and maintains a force on actuator 36 forcing the actuator 36 into a position such that as the platen moves from left to right, the diverter is in displaced position to provide a flow path from the inlet 40 to secondary outlet 42, thereby providing flow from left to right across electrode 14. When the toner platen moves from right to left, the actuator 36 is diverted to the other position and the diverter 45 moves such that inlet 40 is communicating with secondary outlet 44, thereby providing toner flow from right to left on electrode 14. The spring 38 applies a force on actuator 36 to retain the actuator 36 in a central position when the platen 29 is not applying a greater force thereto. Flow is provided from inlet 40 to the primary outlet 41 thereby circulating toner 26 within tray 12.

Figures 6, 7, 8, 9:
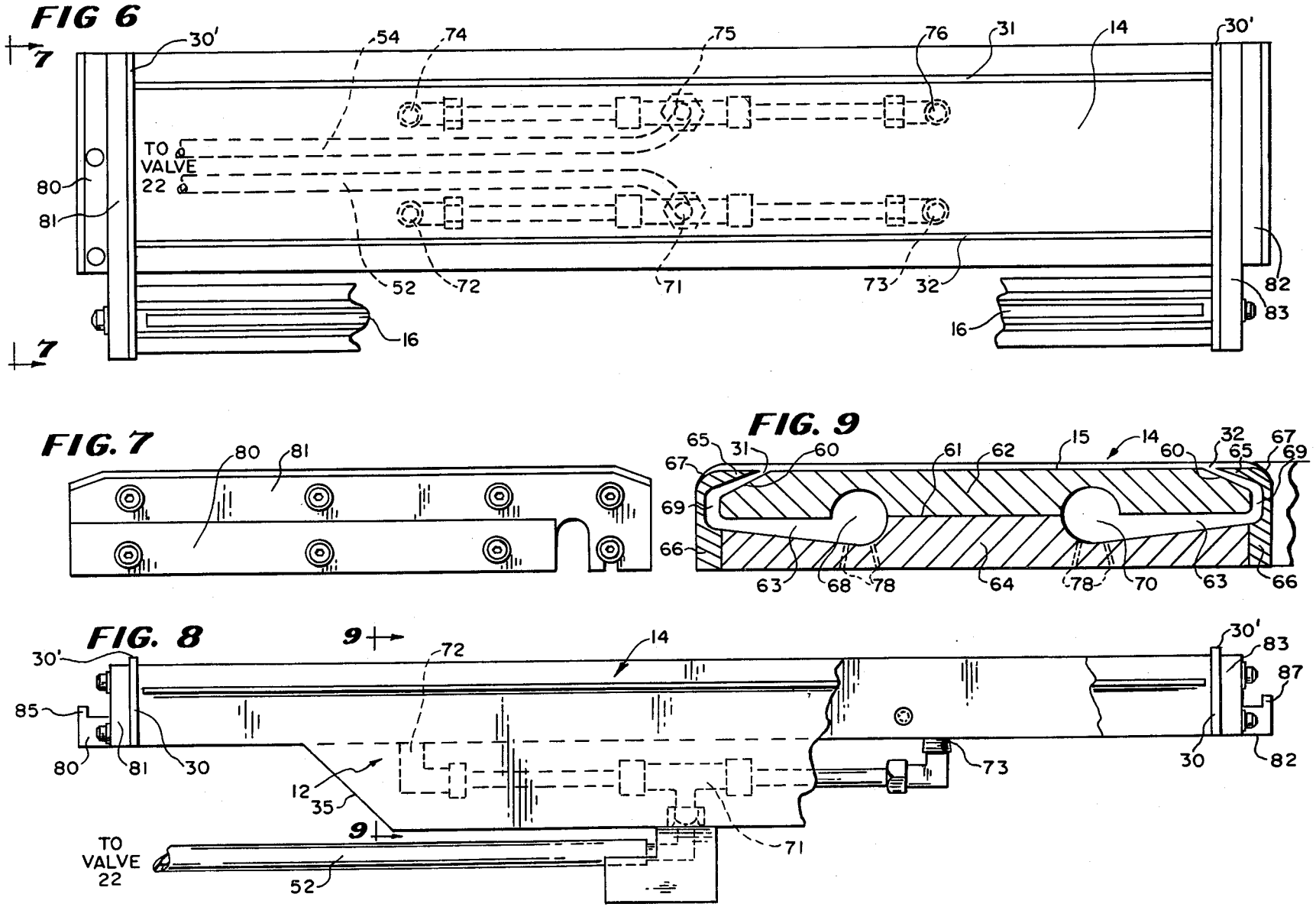
FIG. 6 is a fragmentary top plan view of the toner tray of FIG. 5 having some of the conduits shown in broken line representation.
FIG. 7 is an end view of the toning module taken generally along line 7—7 of FIG. 6 and viewed in the indicated direction.
FIG. 8 is a fragmentary side elevational view of the toning module of FIG. 5 having portions broken away to illustrate details.
FIG. 9 is a sectional view taken generally along line 9—9 of FIG. 8 and viewed in the indicated direction.

Referring to FIG. 9, the development electrode 14 comprises upper plate 62, lower plate 64 and a pair of side members 66. The upper plate 62 has uniform planar top surface 15 having opposite beveled edges 60. The opposite surface 61 of plate 62 has a pair of semicylindrical cross-sectional grooves 68 and 70 formed along its length extending parallel with each other and with the edges of plate 62.

The bottom plate 64 has a planar surface and a pair of matched elongate recesses opening to the longitudinal edges of plate 64. Both side plates 66 are provided with a groove 69 and an outwardly tapered flange portion 65. One corner 67 of each of the side plates 66 is rounded. A pair of spaced through bores are formed in the lower plate 64 communicating too the grooves 68 and 70 and slots 31 and 32.

The plates 62, 64, and 66 are assembled to form the development electrode 14 and together define feed passageways including longitudinal cylindrical passageway 68 and 70 upwardly inclined throughways 63 and curved pasageways 69 terminating in slots 31 and 32, the openings extending lengthwise of the top planar surface 15 of electrode 14 parallel to the longitudinal edges of the electrode 14 and to each other. The passageways 78 are employed to drain the feed passageways 68 and 70.

In the illustrated embodiment of the invention, the liquid toner 26 are circulated continuously within the tray 12. However, liquid toner is caused to flow across the planar surface of the development electrode 14 only when the toning module has been elevated to its toning condition and only in the direction of movement of the platen 29 in its pass over said electrode. For this purpose, the toning module 24 is provided with a bidirectional diverter valve 22.

Openings 72 and 73 are provided communicating with chamber 70 and piping tee 71 shown in FIG. 6. Piping tee 71 is connected to conduit 52 that is connected to secondary outlet fitting 42 of toning valve 22. A flow path is provided from the secondary outlet fitting 42 of valve 22 through conduit 52, tee 71, feed points 72 and 73, chamber 70 to slot 32. Feed points 74 and 76 are communicating with chamber 68 and tee 75, shown in FIG. 6. Tee 75 is connected to conduit 54 that is connected to secondary outlet fitting 44 of toning valve 22. A flow path is provided from the secondary outlet fitting 44 through conduit 54, tee 75, feed points 74 and 76, chamber 68 to slot 31.

The valve 22 provides toner flow across the electrode 14 according to the direction of movement of the platen 29 and thereby acts to enhance uniformity of the toner deposit on the latent electrostatic image. This serves to optimize the proper density or darkness of the image to be toned.

Toner 26 may be circulated through one or both slots 31 and 32 with conduits 52 and 54 connected to a tee (not shown) that is connected to pump 20.

A lift motor 18 is provided to elevate the selected toner tray 12. The lift motor 18 may be a gear motor such as a fractional one-hundredth horsepower (1/100 Hp) motor. A motor 18 having a spring-loaded lift arm 19 is illustrated in FIG. 5.

Figure 13:
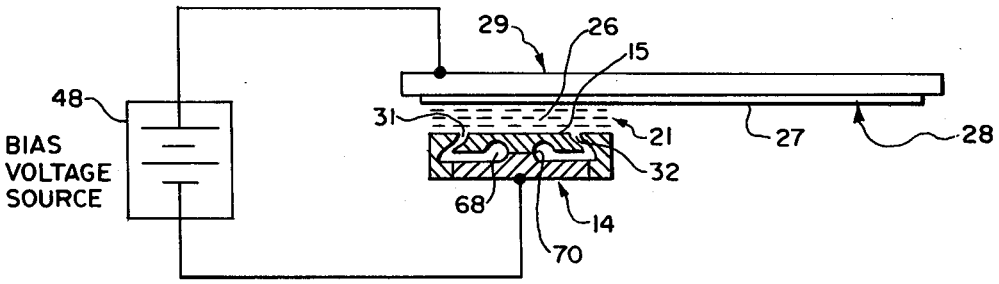
FIG. 13 is explanatory diagram illustrating the toning operation employing the toning apparatus of the invention.

Liquid toner 26 contains toner particles having an electrical charge polarity preserved in a dispersant. Minute residual potentials, or noise voltages, attract small, random amounts of the charged toner particles. The dispersant may also evaporate and the toner particles mechanically fall on a photoconductive surface of the electrophotograhic member 28. In each case, the result is an overall image background fog from stray toner particles in nonimaged areas. A bias voltage is effected between the development electrode 14 and the electrophotograhic member 28 which serves to minimize residual toner background fog. The bias voltage source 48 is a negative D.C. voltage between zero (0) and eight (8) volts, with the development electrode 14 negative relative to the photoconductive surface 27 when an n-type photoconductor material is used shown in FIG. 13. The bias voltage is a positive D.C. voltage between zero (0) and eight (8) volts with the development electrode 14 positive relative to the photoconductive surface 27 when a P-type photoconductive material is used.

The bias voltage 48 that is applied to the development electrode 14 during the toning process is preset for each color toner 26 to provide optimum performance between maximum image density and minimum residual color fog, as may be uniquely inherent with each of the various toners 26. The effective bias voltage may be preset in the range of zero (0) to eight (8) volts separately for each color toner 26 in a multicolor imaging apparatus to best adapt each toner to that density and fog level which best produces a final composite image.

Figure 4:
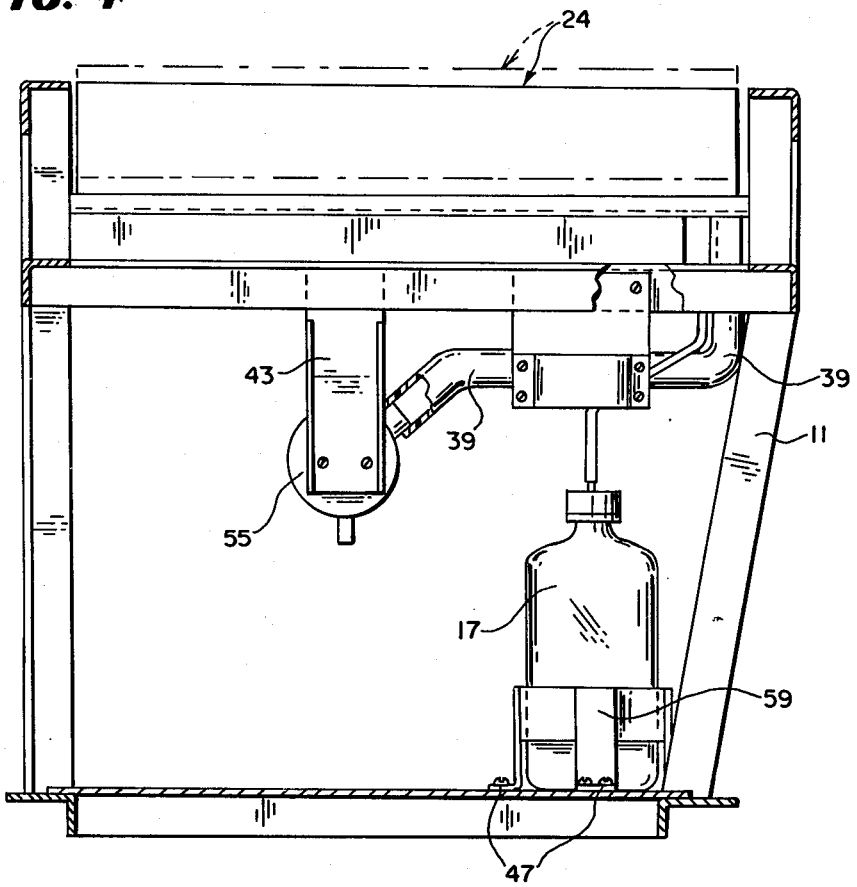
FIG. 4 is a fragmentary sectional view of a portion of the toning apparatus of FIG. 1 taken generally along the line 4—4 of FIG. 3 and in the indicated direction.

In FIG. 4, the toning module is illustrated mounted upon a respective shelf 25 within the electrophotographic color proofing apparatus 10. Module 24 is shown in its inactive disposition at its lower level. The broken line representation illustrates the module 24 disposed at its elevated operational level. The manifold 15 is mounted on brackets 43 as installed to supply negative pressure to the vacuum nozzle 16 via hose 39 when same is installed and for other functions occurring during imaging and transfer.

The toner reservoir 17 is seated within upstanding retainer 59 secured by bolts 47 to the base of the apparatus 10.

Attention now is directed to the sequence of events of the toning operation. An electrically insulating liquid 46 is applied, e.g. as by spraying, to the photoconductive surface 27 just prior to the entry of the platen 29 into the station to wet the photoconductive surface. The liquid 46 preferably is the same as used for the toner dispersant. Prewetting of the photoconductive surface 27 with insulating liquid 46 can act significantly to reduce the amount of background fog or toner particles in the nomimaged area.

The toner tray 12 containing a selected color toner 26 is raised to an elevated position by lift motor 18. When motor 18 is activated, an upwardly directed spring loaded force is applied to tray 12 by rotatable cam arm 19. The bearing surface 30 now is disposed in the path of the platen 29 as it is translated into the toning station after imaging. The leading edge of the platen 29 engages the beveled trailing edge 37 of the bearing surface 30, forcing the toning electrode 14 against its spring bias so as to define a uniform toning gap between the platen 29 and electrophotographic member 28 carried thereby and upper surface of planar electrode 14. This uniform toning gap 21 may be in the range of 0.015 inch. An electrical bias voltage is introduced between the development electrode 14 and the electrophotographic member 28 simultaneously with elevation of the toner tray 12.

Valve 22, where installed, provides for toner flow in the direction of the movement of platen 29 and across planar upper plate surface 15 of development electrode 14.

Where installed, the diverter valve 22 is actuated by the leading edge of the platent 29 against actuator 36 to direct liquid toner flow across the upper surface 15 of the planar electrode 14 through slot 32. The liquid toner 26 floods the upper surface 15 of the planar electrode 14. Some toner enters the slot 31 while the remaining toner sweeps over rounded edges 67 returning to the tray 12 through the space between the longitudinal edge of the planar electrode 14 and the wall of the tray 12.

Toning is usually accomplished in several successive reciprocal translations of platen 29 over the development electrode 14. With each pass actuating the toggle actuator 36 of valve 22 to change the direction of the toner flow. Toning may be provided with a single pass of the member 28 over the electrode 14. As mentioned, the toner suspension may be continuously circulated across the planar surface 15 of electrode 14. In such instance, valve 22 and the attendant connections are eliminated, and toner suspension is directed continuously across the electrode surface 14 from one or both slots 31,32.

During the final pass of platen 29 over the toning electrode 14 a vacuum pump (not shown) is activated and a vacuum is effected at vacuum nozzle 16 located opening adjacent to the toning module 24. Excess residual toner 26 is removed from the photoconductive surface of member 28 by the created suction.

The toner color may be manually selected at the beginning of the cycle period by the machine operator or the controller 90 shown in FIG. 1 provides the function of activating a different one of the serial lift motors 18 in a predetermined sequence for each consecutive latent electrostatic image carried on the photoconductive surface. The controller 90 can be a hard-wired logic unit including relays, latches, gates and switches or a programmable unit including a microprocessor programmed for suitable control logic. The automatic operation of the toning apparatus includes the following steps:

First, platen 29 having the electrophotographic member 28 secured thereon having a latent electrostatic image on the exposed photoconductive surface thereof is moved approaching the toning apparatus 10.

The lift motor 18 is activated for the module carrying the selected color toner 26, and the toner tray 12 is raised to an elevated position by lift arm 19. Simultaneously, a preset DC bias voltage 48 is applied to the platent 29, relative to the planar development electrode 14 illustrated in FIG. 13.

Where present, valve 22 is operated by the movement of platen 29 mechanically contacting the valve actuator 36 thereby providing flow of toner 26 across the development electrode 14 in the direction of the movement of member 28.

Liquid toner 26 fills the gap 21 between the photoconductive surface 27 carrying the latent electrostatic image and the planar surface 15. The charged toner particles are attracted to the latent image and render the image visible as the platen 29 is translated over said electrode 14. Toning may be provided in three reciprocal translations of the platen 29 over the electrode 14. As the platen 29 leaves the development electrode, the photoconductive surface is vacuum cleaned.

In an apparatus of the invention, for example, the electrophotographic member may have a size of 550 millimeters by 650 millimeters with the planar toning development electrode having a width 101.6 millimeters and length of 670 millimeters. The gap provided between the electrode 14 and the electrophotographic member 28 may be 0.38 millimeters. The member to be toned may be moved over the toning apparatus at a speed of 38 millimeters per second, the range of 12.5 millimeters per second to 125 millimeters per second (12.5 mm to 125 mm per second). Toning may be accomplished in less than one minute. For full color imaging and toning each of the four color modules carry a different toner color, namely, yellow, magenta, cyan and black.

The apparatus provides for interchangeable modules that conveniently can be removed for cleaning or other servicing. Spraying the electrophotographic member prior to toning with an insulative fluid hydrocarbon is believed significantly to improve image quality in that it minimizes background fog on the developed image. This effect is believed to occur due to the thin film produced on the photoconductive surface acting to reduce the direct contact photoconductive surface and the toner particles. Applying a selected, preset electrical bias field related to the selected color toner within the gap between the toning electrode and the member to be toned acts further to minimize background fog. The uniformity of the toner deposit may be further enhanced by providing toner flow substantially in the direction of the movement of the electrophotographic member.

What it is desired to secure by Letters Patent of the United States is:

1. Apparatus for producing a toned image from a latent electrostatic image carried on the photoconductive surface of an electrophotographic member comprising:

A. platen means for mounting the electrophotographic member having the photoconductive surface such that the surface faces downward, B. a toning module including i. a planar development electrode mounted on the module and having an upper surface, ii. a sump adapted to carry a supply of liquid toner therein suitable for developing said latent image, iii. slot means extending substantially along the length of said electrode adjacent opposite parallel edges of said electrode, iv. fluid coupling means between said sump and said slot means and including means for circulating said toner within said sump to flow through said slot means, across said upper surface of said development electrode and back to said sump whereby to establish a fluid toner layer of a generally predetermined thickness on the upper surface of said electrode, C. means for moving the electrophotographic member mounting means and the toning module relative to one another such that the upper surface of said electrode and the photoconductive surface of the electrophotographic member when carried by said mounting means will pass one another along parallel spaced-apart horizontal planes, D. means resiliently biasing said development electrode toward a disposition in intercepting relation with said platen means, E. said toning module having spacing slider means adapted to intecept said platen means during said relative movement and thereby displace said development electrode against its biased disposition to dispose the upper surface thereof a predetermined distance from the photoconductive surface during passage of said upper surface and the photoconductive surface past each other, whereby directly to establish a precise toning gap between said upper surface and the photoconductive surface that is at most the thickness of said fluid toner layer and F. means for establishing an electrical bias field across said gap.

2. The apparatus as claimed in claim 1 in which the means for mounting the electrophotographic member are constructed and arranged to hold said member in a flat horizontal plane constituting one of said spaced apart horizontal planes.

3. The apparatus as claimed in claim 1 in which means are provided for bodily moving said toning module downward from an upper position to a lower position to increase the space between said upper surface of said development electrode and said mounting member substantially beyond the thickness of said fluid toner layer so that the relative movement will not enable liquid toner to be engaged with the photoconductive surface.

4. The apparatus as claimed in claim 3 in which there are a plurality of toning modules fixed alongside of one another and said mounting means are arranged to move in a horizontal planar path over all said modules, means being provided for said modules to be normally disposed in their respective lower positions, there being means for raising a different module to said upper position in a predetermined sequence.

5. The apparatus as claimed in claim 1 and means for removing excess residual toner from the photoconductive surface.

6. The apparatus as claimed in claim 1 and means for directing toner flow across the upper surface of said electrode in the direction of movement of said mounting means relative thereto.

7. The apparatus as claimed in claim 1 and support standards for said toning module forming together a unit adapted to be assembled independently.

8. The apparatus as claimed in claim 1 in which said spacing means include an actuator that lifts said sump to an elevated position and functions as said resilient biasing means to provide upwardly directed spring-loaded force on said development electrode and said slider means having antifriction bearing surfaces and being mounted on said sump extending above said top surface of said development electrode to provide said gap when said electrode is displaced by said platen means.

9. The apparatus as claimed in claim 1 in which the means for circulating said liquid toner include pump means.

10. The apparatus as claimed in claim 1 wherein means for establishing an electrical bias field across said gap include D.C. power supply electrically coupled to the electrophotographic member and said development electrode.

11. The apparatus as claimed in claim 10 wherein said D.C. power supply is adjustable between zero to eight volts with said electrode being negative relative to the n-type material photoconductive surface.

12. The apparatus as claimed in claim 10 wherein said D.C. power supply is adjustable between zero to eight volts with said electrode being positive relative to the p-type material photoconductive surface.

13. Apparatus for producing a toned image from a latent electrostatic image carried on the photoconductive surface of an electrophotographic member comprising:

A. platen means for mounting the electrophotographic member having the photoconductive surface such that the surface faces downward, B. a toning module including i. a planar development electrode mounted on the module and having an upper surface, ii. a sump adapted to carry a supply of liquid toner therein suitable for developing said latent image, iii. slot means extending substantially along the length of said electrode adjacent opposite parallel edges of said electrode, iv. fluid coupling means between said sump and said slot means and including means for circulating said toner within said sump to flow through said slot means, across said upper surface of said development electrode and back to said sump whereby to establish a fluid toner layer of a generally predetermined thickness on the upper surface of said electrode, C. means for moving the electrophotographic member mounting means and the toning module relative to one another such that the upper surface of said electrode and the photoconductive surface of the electrophotographic member when carried by said mounting means will pass one another along parallel spaced-apart horizontal planes, D. said toning module having spacing means adapted to be engaged by said mounting means during said relative movement whereby to establish a gap between said upper surface and the photoconductive surface that is at most the thickness of said fluid toner layer and E. means for establishing an electrical bias field across said gap, F. means for directing toner flow across the upper surface of said electrode in the direction of movement of said mounting means relative thereto, and G. means for determining the direction of toner flow on said upper surface of said electrode including a valve.

14. An apparatus for producing a toned image from a latent electrostatic image carried on the photoconductive surface of an electrophotographic member including mounting means for the electrophotographic member, a toning development electrode having an upper surface, means for flowing liquid toner on the upper surface development electrode and means for moving the electrophotographic member mounting means and the toning development electrode relative to one another such that the upper surface of the development electrode and the photoconductive surface of the electrophotographic member when carried by the mounting means will pass one another along spaced-apart horizontal planes, the improvement comprising means for determining the direction of toner flow on the upper surface of the toning development electrode including a valve having a valve body having an inlet, a primary outlet, first and second secondary outlets and a chamber communicating with said inlet and said outlets, a diverter movable and resiliently suspended within said chamber, spring means disposed in contact engagement with said diverter and providing a force thereon to maintain said diverter in a neutral position, said neutral position of said diverter providing a fluid flow path between said inlet and said primary outlet, an actuator coupled to said diverter and extending outward of said valve body and capable of being moved between a neutral position and first and second positions, said actuator being moved to said first position thereby moving said diverter to a first position providing a fluid flow path between said inlet and said first secondary outlet and said actuator being moved to said second position thereby moving said diverter to a second position providing a fluid flow path between said inlet and said secondary secondary outlet.

15. The apparatus as claimed in claim 5 wherein there is a nozzle opening disposed adjacent said development electrode, a source of vacuum and conduit means coupling said vacuum source to said nozzle and said means for removing excess residual toner include means for effecting a vacuum at said nozzle opening extending substantially along the length of said electrode.

16. A method for producing a toned image from a latent electrostatic image carried on the photoconductive surface of an electrophotographic member comprising:

A. mounting the electrophotographic member on a planar carrier with the photoconductive surface disposed to face downwardly, B. loading liquid toner into toner module means, said toner module means having a development electrode mounted on the top surface thereof, C. moving the electrophotographic member toward said toner module means, D. raising said module means to an upper position with an upwardly directed spring-loaded force applied to said electrode disposing same in intercepting condition relative to the path of said carrier, E. applying a low D.C. voltage between the member and said electrode to effect an electrical bias field therebetween, F. providing a flow of said liquid toner across said electrode, G. establishing a gap between said electrode and said member by displacing said electrode against its spring-bias to a predetermined distance from said surface and urging said electrode to the predetermined spacing once the electrode is intercepted by said carrier and H. moving the photoconductive surface across said electrode while maintaining the gap during relative cross-passage of said carrier and electrode.

17. A method as claimed in claim 16 and the step of lowering said module after toning is completed to a level out of toning proximity to the photoconductive surface.

18. A method as claimed in claim 16 and the step of directing the flow of said liquid toner across said electrode in the direction of movement of said electrophotographic member.

19. A method as claimed in claim 16 and the step of continuously flowing liquid toner across said electrode.

20. A method as claimed in claim 16 and the step of removing excess toner from the photoconductive surface subsequent to toning.

21. A method as claimed in claim 16 and the step of applying an electrically insulating liquid to the photoconductive surface prior to applying said toner thereto.

22. A method as claimed in claim 16 in which said electrical bias field is effected prior to flowing said toner across said electrode.

23. A method as claimed in claim 16 in which said electrical bias field is maintained beyond the time to tone the latent image.

24. The method as claimed in claim 16 in which the photoconductive surface is a p-type material and said D.C. voltage is applied and said electrode is positive relative the surface.

25. The method as claimed in claim 16 in which the photoconductive surface is an n-type material and the said D.C. voltage is applied and said electrode is negative relative the surface.

26. The method as claimed in claim 16 and the step of removing excess residual toner from said toned member is provided by moving the photoconductive surface over a vacuum source after toning.

27. The method as claimed in claim 16 and the step of continuously circulating said liquid toner within said module.

28. A method for toning the latent image on a charged electrophotographic member which has been exposed to a radiation pattern which member includes an effective ohmic layer and photoconductive coating, the latent image being formed by selective charge redistribution in the photoconductive coating in increments dependent upon the amount of radiation received and to selectively attract toner particles of one polarity related to the charge acceptance characteristic of the coating for each increment of charge at the surface in inverse relation to the amount of radiation received by the increment, said method comprising:

providing a toning module, providing planar development electrode on said toning module at the upper portion thereof, providing slide means adjacent said development electrode and extending above the upper surface thereof, disposing the electrophotographic member to face downwardly toward the development electrode, moving the electrophotographic member toward said toning module, lifting the toning module to an elevated position with an upwardly directed spring-loaded force applied to said development electrode, disposing the development electrode in a path to enable said slide means to intercept the carrier so as to displace the development electrode from its intercepting position to parallel position a predetermined distance from the member, applying a low D.C. voltage between the member and said development electrode to effect an electrical bias field therebetween, providing toner flow across said development electrode, effecting the interception and thereby establishing the predetermined gap between said electrode and the member and, moving the electrophotographic member over and past said development electrode while the gap is maintained.

29. The method as claimed in claim 28 and the step of applying an electrically insulating liquid to the photoconductive surface prior to applying said toner thereto.

30. Apparatus for producing a toned image from a latent electrostatic image carried on the photoconductive surface of an electrophotographic member comprising:

A. means for mounting the electrophotographic member having the photoconductive surface such that the surface faces downward, B. a plurality of toning modules fixed alongside of one another, each of said toning modules carrying a different color toner, and each including i. a planar development electrode mounted on the module and having an upper surface, ii. a sump adapted to carry a supply of liquid toner therein suitable for developing said latent image, iii. slot means extending along substantially the length of said electrode adjacent opposite parallel edges of said electrode, iv. fluid coupling means between said sump and said slot means and including means for circulating toner within said sump to flow through said slot means, across said upper surface of said development electrode and back to said sump whereby to establish a fluid toner layer of a generally predetermined thickness on the upper surface of said electrode, C. means for raising a different one of said toning modules to an upper position in a predetermined sequence for each consecutive latent electrostatic image carried on the photoconductive surface, D. resilient means for biasing said development electrode into the path of said mounting means, E. means for moving the electrophotographic member mounting means over said raised toning module such that the upper surface of said electrode and the photoconductive surface of the electrophotographic member when carried by said mounting means will pass one another along parallel spaced apart horizontal planes, F. each of said toning modules having spacing slide means for interception by said mounting means with said module in said upper position and with the electrode in its resiliently biased condition during said movement of said mounting means, G. effecting said interception to displace said electrode surface a predetermined distance from said photoconductive surface whereby directly to establish a gap between said upper surface of said development electrode and the photoconductive surface that is at most the thickness of said fluid toner layer, H. means for establishing an electrical bias field across said gap and I. means for lowering said toning module from said upper position to a lower position subsequent to said mounting means moving thereacross.

31. The apparatus as claimed in claim 20 wherein said means for raising a different one of said toning modules to an upper position in a predetermined sequence for each latent electrostatic image carried on the photoconductive surface include one of a programmable controller and hardwired logic controller, said raised toning module being lowered prior to raising of the next to be employed toning module.

32. A method for producing a toned image from a latent electrostatic image carried on the photoconductive surface of an electrophotographic member comprising:

A. providing a plurality of toning modules, each of said toning module means having a development electrode mounted on the top surface thereof, B. disposing the photoconductive surface on a carrier and facing downwardly toward the development electrode, C. loading selected color liquid toners separately into a plurality of toner module, D. moving the electrophotographic member toward said toning modules, E. raising one of said module means to an upper position with an upwardly directed spring-loaded force applied to said development electrode, F. providing slide means on said toning modules in intercepting disposition relative the path of said carrier when said module means are at the upper position, G. applying a low D.C. voltage between said member and said development electrode to effect an electrical bias field therebetween, H. providing a flow of said liquid toner across said electrode, I. displacing said development electrode against its bias by effecting said interception and thereby establishing a predetermined toning gap between said electrode and said member, J. moving said photoconductive surface across said electrode maintaining engagement with said slide means, and K. lowering said toning module from said upper position to a lower position.

33. A method as claimed in claim 32 in which said raising one of said toning modules to an upper position is performed in a predetermined sequence with raising only a different one of said plurality of modules for each consecutive latent electrostatic image carried on the photoconductive surface and lowering the raised module before the next module is raised for the next consecutive latent electrostatic image.

34. A method as claimed in claim 32 and the step of applying an electrically insulative liquid to the photoconductive surface prior to applying said toner thereto.

35. A method as claimed in claim 32 and the step of removing excess toner from the photoconductive surface subsequent to toning.

36. A method as claimed in claim 32 in which said electrical bias field is effected prior to flowing toner across said development electrode.

37. A method as claimed in claim 32 and maintaining said electrical bias field beyond the duration required to tone the latent image.

38. A method as claimed in claim 32 and the step of applying a vacuum to the photoconductive surface when toning is completed to remove any residual non-electrostatically held toner therefrom.

* * * * *